US007125238B2

(12) United States Patent
Reutter et al.

(10) Patent No.: US 7,125,238 B2
(45) Date of Patent: Oct. 24, 2006

(54) APPARATUS FOR MELT-SPINNING FILAMENTS IN A YARN FORMING OPERATION

(75) Inventors: Tilman Reutter, Schönböken (DE); Christian Vollmers, Bad Bramstedt (DE)

(73) Assignee: Saurer GmbH & Co. KG, Monchengladbach (DE)

( * ) Notice: Subject to any disclaimer, the term of this patent is extended or adjusted under 35 U.S.C. 154(b) by 0 days.

(21) Appl. No.: 11/233,342

(22) Filed: Sep. 22, 2005

(65) Prior Publication Data

US 2006/0013912 A1 Jan. 19, 2006

Related U.S. Application Data

(63) Continuation of application No. PCT/EP2004/003212, filed on Mar. 26, 2004.

(30) Foreign Application Priority Data

Mar. 29, 2003 (DE) ..... 103 14 294

(51) Int. Cl.
*D01D 5/08* (2006.01)

(52) U.S. Cl. ..... 425/192 S; 425/382.2; 425/464

(58) Field of Classification Search ..... 425/382.2, 425/464, 192 S
See application file for complete search history.

(56) References Cited

U.S. PATENT DOCUMENTS 3,500,499 A 3/1970 Goossens
3,891,379 A * 6/1975 Lenk ..... 425/464
4,681,522 A * 7/1987 Lenk ..... 425/72.2
4,696,633 A * 9/1987 Lenk et al. ..... 425/192 S
4,801,257 A * 1/1989 Lenk ..... 425/192 S
5,352,106 A * 10/1994 Lenk et al. ..... 425/131.5
5,387,097 A 2/1995 Scheiber et al.
5,662,947 A * 9/1997 Kretzschmar et al. ... 425/192 S
6,083,432 A * 7/2000 Schafer ..... 264/39
6,716,016 B1 4/2004 Beeck et al.

FOREIGN PATENT DOCUMENTS

| | | |
|---|---|---|
| DE | 1 660 375 | 4/1972 |
| DE | 42 36 570 A1 | 6/1993 |
| DE | 199 35 982 A1 | 2/2001 |
| EP | 0 828 017 A2 | 3/1998 |
| EP | 0 931 863 A2 | 7/1999 |
| JP | 10001817 | 1/1998 |

* cited by examiner

*Primary Examiner*—Joseph S. Del Sole
(74) *Attorney, Agent, or Firm*—Alston & Bird LLP

(57) ABSTRACT

An apparatus for melt spinning a plurality of strand-like filaments through a spinneret, which is mounted within a downwardly open receptacle in a nozzle holder. The spinneret includes a housing which is deformed by the entry of the pressurized polymeric melt into an internal diffuser chamber, so as to press the spinneret against the inner wall of the receptacle and thereby seal the melt inlet of the spinneret against the melt outlet in the receptacle. Thus the high pressure forces required for sealing only arise and are active during the operational state, and the spinneret can be otherwise held in the nozzle holder under a minimal securing force which permits the spinneret to be easily loosened and removed for periodic maintenance.

10 Claims, 2 Drawing Sheets

APPARATUS FOR MELT-SPINNING FILAMENTS IN A YARN FORMING OPERATION

CROSS REFERENCE TO RELATED APPLICATION

The present application is a continuation of international application PCT/EP2004/003212, filed 26 Mar. 2004, and which designates the U.S. The disclosure of the referenced application is incorporated herein by reference.

BACKGROUND OF THE INVENTION

The present invention relates to a apparatus for the melt-spinning of a plurality of strand-like filaments in a yarn forming operation.

For the melt-spinning of synthetic fibers, a melted polymer material is extruded to form a plurality of strand-like filaments. For this, it is necessary that the polymer melt be pressed through nozzle holes. The extrusion, which is also called spinning out, is done by a spinneret which comprises on its underside a plurality of nozzle holes. In practice, several spinnerets of this type are used simultaneously alongside one another in order to extrude several fiber bundles in parallel to one another. For this, the spinnerets are held in a nozzle holder.

In operation, it is necessary that the spinnerets be removed and given maintenance at regular intervals. The removal of the spinnerets is laborious and causes unavoidable downtimes which lead to a loss of production. There is thus the desire to fashion the design of the spinnerets, as well as the connection of the spinnerets to a nozzle holder, in such a way that they can be removed in as simple a manner as possible. Here the leak-tightness of the components must be ensured at all times during operation since the polymer melt is conducted and extended under a high melt pressure.

Apparatus are known from DE 199 35 982 A1, DE 42 36 570 A1, and the corresponding U.S. Pat. Nos. 6,716,016 and 5,387,097, respectively in which the spinnerets or spinneret blocks are secured in place in the nozzle holder in order to make the interface between a melt outlet of the nozzle holder and a melt inlet of the spinneret pressure-tight. For this, a cylindrical seal is secured in place between the melt outlet and the melt inlet. However, apparatus of this type have the basic disadvantage that during operation a deformation of the sealing ring occurs so that a securing in place between the sealing ring and the nozzle holder hinders the loosening of the spinneret. In addition to this, the spinneret must be secured in place against the nozzle holder with high securing forces in order to ensure the sealing function at the interface between the melt outlet and the melt inlet so that correspondingly high de-securing forces are required to loosen the spinneret.

DE 16 60 375 and corresponding U.S. Pat. No. 3,500,499 discloses an apparatus in which the housing and the nozzle plate of the spinneret are held in a receptacle of the nozzle holder in such a manner that they can move relative to one another and in such a manner that the connection between the melt outlet of the nozzle holder and the melt inlet of the spinneret is sealed automatically. However, the movable arrangement of the individual parts of the spinneret has the great disadvantage that the spinneret is not held in the nozzle holder in such a manner that it can be removed as a structural unit. Furthermore, the concept requires an additional sealing point within the spinneret.

It is accordingly an object of the invention to provide a melt spinning apparatus of the type stated initially in such a manner that, on the one hand, the spinneret is held in the nozzle holder in such a manner that it can be loosened easily and, on the other hand, high pressure forces for sealing can be produced between the spinneret and the nozzle holder.

SUMMARY OF THE INVENTION

The above and other objects and advantages of the invention are achieved by the provision of a melt spinning apparatus which comprises a spinneret which comprises a housing which includes a central connecting piece having a melt inlet opening extending therethrough, an annular wall extending radially outwardly from the connecting piece, and a collar extending about the outer periphery of the annular wall. The spinneret further comprises a nozzle plate containing a plurality of nozzle openings and which is mounted to or adjacent the collar of the housing in spaced relation below the annular wall, so as to define a diffuser chamber between said annular wall and the nozzle plate.

The spinneret is mounted within the receptacle of the nozzle holder with the central connecting piece of the housing abutting the inner wall of the receptacle and so that the melt inlet of the housing communicates with the melt outlet of the nozzle holder.

Also, the annular wall of the housing of the spinneret is sufficiently thin and formed of a material to be elastically deformable when a melt is conducted under pressure into the diffuser chamber of the housing and so as to press the central connecting piece of spinneret against the inner wall of the receptacle and seal the melt inlet against the melt outlet.

The invention is distinguished by the fact that the high pressure forces required for sealing only arise and act in the operational state. For this, the annular wall of the housing of the spinneret is formed to be elastic in such a manner that under the action of the melt pressure a deformation of the housing of the spinneret occurs and that the deformation of the housing produces a pressure force for the self-sealing securing in place of the spinneret in the nozzle holder. Thereby the spinneret can be held in the nozzle holder with low securing forces which act only to fix the spinneret in the nozzle holder. Only in the operational state does the melt pressure acting in the spinneret produce a deformation of the housing and thus a self-sealing pressure force.

An additional advantage of the invention is given by the fact that the level of the pressure force for self-sealing securing in place is proportional to the melt pressure. Thus, the connection of the spinneret to the nozzle holder itself remains pressure tight even at the highest melt pressures.

In the case of a particularly advantageous configuration of the invention, the spinneret and the nozzle holder are connected to one another by a securing means which produces a securing force. Therein the securing force produced by the securing means and the pressure force produced by the deformation of the housing have the same direction. Thus, the spinneret can be held in the nozzle holder even with relatively low securing forces or loosened from the nozzle holder with relatively low de-securing forces.

In order, in the case of pre-mounted spinnerets, not to get an adverse effect between the individual parts, such as, for example, the nozzle plate and the housing, the embodiment of the invention is particularly preferred in which the annular wall of the housing has a form and a material which leads to a directionally related deformation under pressure. In particular, a predefined deformation under melt pressure can be achieved by a particular shaping of the housing. Thus, maximum pressure forces can be produced at those sealing points that are to be sealed.

The sealing joints formed between the melt outlet of the nozzle holder and the melt inlet of the spinneret can even be advantageously sealed by the wall of the housing in the area of the melt outlet in such a manner that it is deformable under pressure. The deformation produced by the pressure force thus acts directly on the sealing face formed between the spinneret and the nozzle holder.

To ensure the necessary strength of the housing, the wall of the housing is preferably formed as a thin-walled spherical cap. With this, a maximum deformability is achieved with maximum strength of the housing. In principle however, any shaping of the housing is possible which causes the desired elastic deformation.

The embodiment of the invention in which a sealing ring is disposed between the melt outlet of the nozzle holder and the melt inlet of the housing is distinguished by the fact that even the slightest deformations of the housing lead to a high sealing action.

The apparatus according to the invention is moreover distinguished by a low weight of the spinneret, which leads to an improved handling during mounting and dismounting of the spinneret in the nozzle holder. In addition to this, a reduced expenditure in apparatus is possible due to there being fewer components.

In the following, several embodiments of the apparatus according to the invention are described in more detail with reference to the accompanying drawings.

DETAILED DESCRIPTION OF THE PREFERRED EMBODIMENTS

Figure 1:
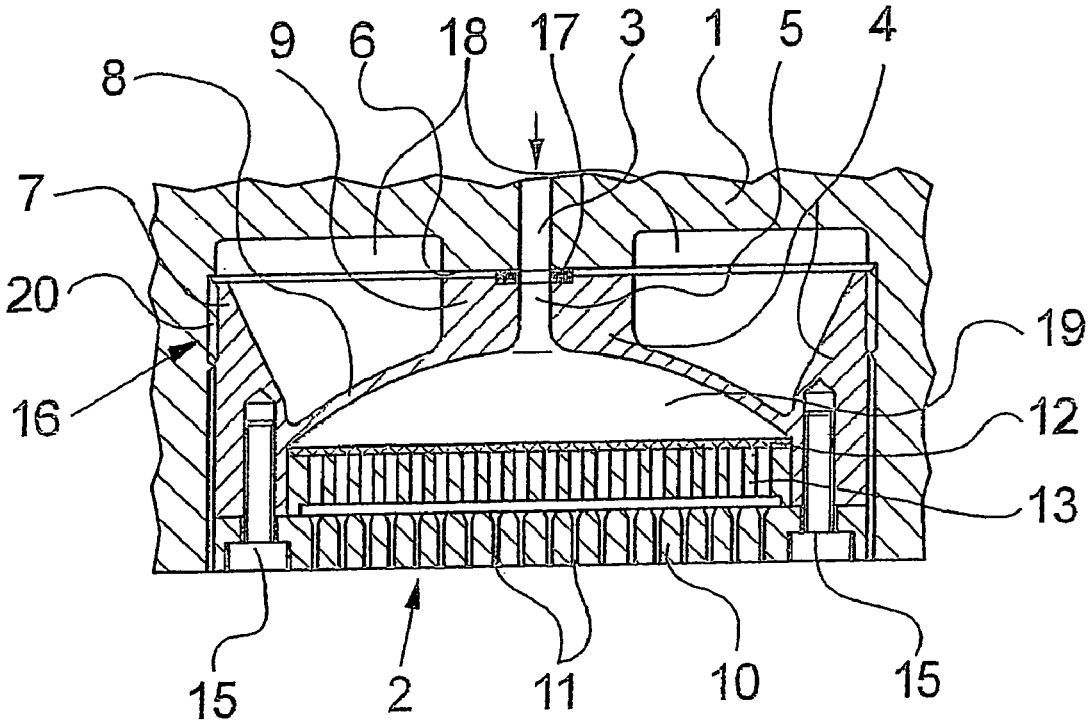
FIG. 1 schematically illustrates a cross-section of a first embodiment of the apparatus according to the invention, and FIG. 2 schematically illustrates a cross-section of another embodiment of the apparatus according to the invention.

In FIG. 1 a cross-section of a first embodiment of the apparatus according to the invention is shown in schematic form. The apparatus comprises a nozzle holder 1 which comprises on an underside a downwardly opening receptacle 18 which is configured to receive a spinneret 2. The nozzle holder 1 usually comprises on the underside several such receptacles (not represented here) to receive several spinnerets. For each receptacle 18 the nozzle holder 1 contains a melt outlet 3, via which a polymer melt is fed to the spinneret 2. The nozzle holder 1, which is also designated as a so-called spinning beam, contains additional melt feeding components such as lines and spinning pumps, which are not represented here.

The nozzle holder 1 is formed in such a manner that it can be heated. Thus, the melt feeding components received by the nozzle holder 1 can be kept at a specified temperature at their walls or the walls of the nozzle holder by a heat transfer medium or by an electrical heating element.

The spinneret 2 comprises a housing 4 and a nozzle plate 10 which is secured on the underside of the housing 4 via the bolts 15. The nozzle plate 10 comprises a plurality of nozzle openings 11 which serve as the melt outlets. A perforated plate 13 and a filter insert 12 supported on the perforated plate 13 are disposed on the nozzle plate 10. Within the housing 4 a diffuser chamber 19 is disposed above the filter insert 12. The diffuser chamber 19 is connected, via a melt inlet 5 in the housing 4, to the melt outlet 3 of the nozzle holder 1.

The housing 4 of the spinneret 2 consists essentially of three components. The first component is formed by a connecting piece 9 which is formed in the center and contains the melt inlet 5. The preferably cylindrical connecting piece 9 is disposed so as to be concentric with the melt outlet 3 of the nozzle holder 1. Encircling the connecting piece 9 in the form of a ring, a second component of the housing 4 is formed by the annular wall 8. The wall 8 is formed as a thin-walled spherical cap, the curvature of which essentially forms the diffuser chamber 19. This component is formed so as to be elastic in such a manner that a deformation under pressure is possible.

A third component of the housing 4 is formed as an external, stable, threaded collar 7 which extends about the periphery of the wall 8. The threaded collar 7 serves on one side to receive several of the bolts 15 through which the nozzle plate 10 is connected to the housing 4 in a pressure-tight manner and on another side to receive an external thread 20 which is connected to the nozzle holder 1 via a threaded joint 16.

The spinneret 2 is held in the receptacle 18 of the nozzle holder 1 via the threaded joint 16. Therein the spinneret 2 is threaded onto the nozzle holder 1 until the housing 4 with the melt inlet 5 abuts the nozzle holder 1 at the sealing face 6 of the melt outlet 3. The interface between the melt outlet 3 and the melt inlet 5 is sealed in the outward direction by an additional sealing ring 17. A securing force for the fixation of the spinneret 2 is produced by the threaded joint 16 acting as securing means so that no gap between the housing 4 and the nozzle holder 1 occurs at the sealing face 6.

In the operational state, a polymer melt is conducted under high pressure from the nozzle holder 1, via a melt outlet 3, into the melt inlet 5 and diffuser chamber 19 of the spinneret housing 4. The melt pressure present within the diffuser chamber 19 acts from inside on the wall 8 of the housing 4. The wall 8 is formed to be thin in such a manner that a slight elastic deformation is possible. The deformation acting essentially on the wall 8 leads to the connecting piece 9 with the sealing ring 17 being pressed onto the sealing face 6. The wall 8 is formed to be elastic so that the deformation of the housing is only present under the action of the melt pressure. The pressure force acting on the sealing face due to the deformation leads to a self-sealing securing in place of the spinneret 2 within the receptacle 18.

It will be noted that the pressure force produced by the deformation has the same direction as the securing force for the spinneret 2 produced by the threaded joint 16.

Within the diffuser chamber 19 the polymer melt is fed, under the action of the melt pressure, through the filter insert 12 and the perforated plate 13 in order then to be extruded as fine filament strands through the nozzle holes 11 of the nozzle plate 10. In so doing, the sealing between the nozzle plate 10 and the housing 4 can be achieved by an additional ring seal (not represented here). Along with this, the pressure force for sealing in the outward direction is produced by the bolts 15 which are disposed uniformly on the circumference of the nozzle plate 10.

In case replacement of the spinneret 2 is required, the feeding of the melt is first discontinued so that within the spinneret 2, therefore within the diffuser chamber 19, the melt pressure drops off. With this, the elastic deformation of the housing 4 returns to its original state. The spinneret 2 is only held via the securing force applied by the threaded joint 16. To loosen the spinneret 2 correspondingly low de-securing forces are needed.

Figure 2:
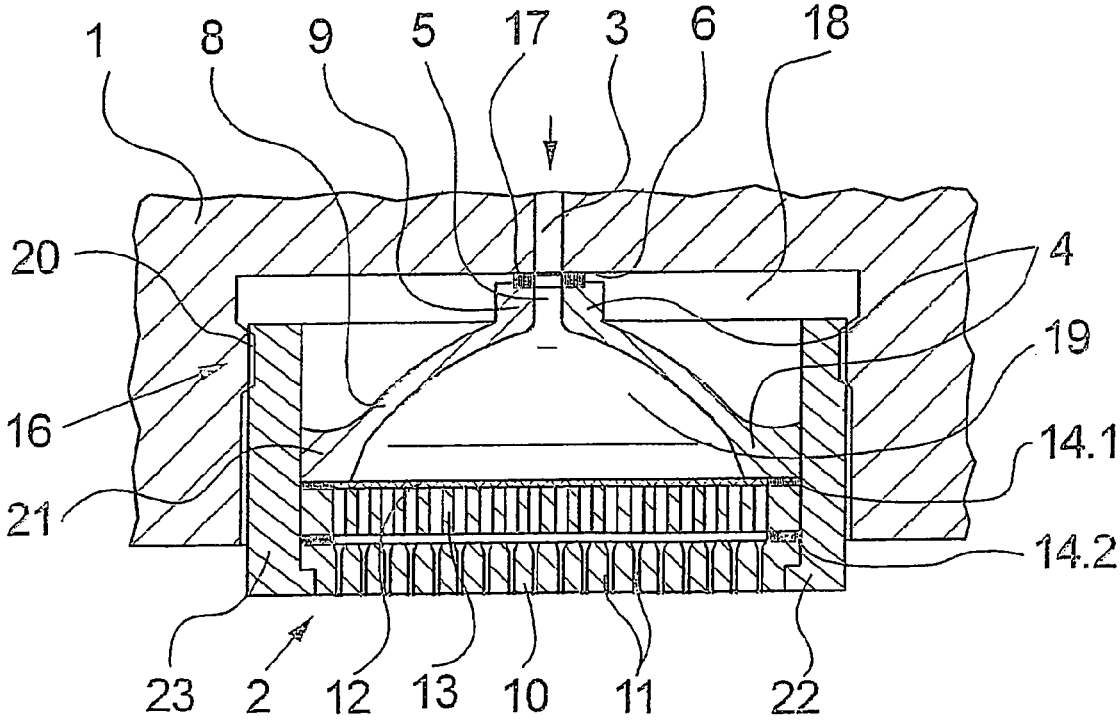

In FIG. 2 another embodiment of the apparatus according to the invention is shown in schematic form. The components with the same function have been given the same reference numbers there.

The nozzle holder 1 is embodied in a manner essentially identical to the foregoing embodiment according to FIG. 1 so that reference can be made to the foregoing description.

The spinneret 2 is formed by the housing 4, filter insert 12, perforated plate 13, and nozzle plate 10. Here the housing 4 is held with the nozzle plate 10 in a cylindrical threaded sleeve 23, which is held in the nozzle holder 1 by means of the threaded joint 16 via an external thread 20. Also, the housing 4 is formed of integral one piece construction which includes a central connecting piece 9 with the melt inlet 5, the thin wall 8 which encircles the connecting piece 9, and an encircling supporting collar 21. A first ring seal 14.1 is disposed between the filter insert 12 and the supporting collar 21 of the housing 4. A second ring seal 14.2 is disposed between the perforated plate 13 and the nozzle plate 10. The nozzle plate 10 is supported on a holding collar 22 at the bottom end of the threaded sleeve 23.

In the embodiment represented in FIG. 2, the spinneret 2 is secured in place in the nozzle holder 1 by the threaded joint 16 via the threaded sleeve 23. Here an encircling sealing ring 17 concentric to the melt inlet 5 is flush with the sealing face 6 of the melt outlet 3 of the nozzle holder 1. The mounting of the spinneret 2 is accomplished by the threaded sleeve 23, in so doing with a securing force which produces no significant pressure forces for sealing at the sealing points of the spinneret 2.

The pressure forces for the self-sealing securing in place of the spinneret 2 are only achieved in the operational state by the deformation of the housing 4. For this, the polymer melt first reaches, via the melt outlet 3, the melt inlet 5, and the diffuser chamber 19. The melt pressure in the diffuser chamber 19 then causes an elastic deformation of the wall 8 of the housing 4 in such a manner that, due to the deformation of the housing 4 in the direction of the receptacle 18, via the connecting piece 9 additional pressure forces are built up which lead to the securing in place of the spinneret 2. Through the use of the seals 14.1, 14.2, and 17 in the joints of the individual parts it is ensured that, in the operational state at the existing melt pressure, a sufficient sealing at the sealing points of the spinneret 2, as well as the connection between the spinneret and the nozzle holder 1, is ensured in the outward direction.

The function of the apparatus represented in FIG. 2 is identical to the embodiment according to FIG. 1. To that extent, reference is made to the foregoing embodiment. Within the diffuser chamber 19 melt pressures of up to 250 bar are reached in the process. To filter the polymer melt, the filter insert 12 is preferably formed by one of the several sieves with different mesh widths. It is however also possible to use, above the perforated plate 13, a filter insert for a filter granulate having different grain sizes.

The design of the represented embodiments of the apparatus according to the invention, as well as the design of the individual parts, is merely given as an example. The invention subsumes all the apparatus for melt-spinning which comprise the spinnerets, housing, or housing parts which, with pressure present, lead to a deformation and thus to a self-sealing securing in place. The leak-tightness of the nozzle block is thus independent of the pressure force which acts between the spinneret and the nozzle holder for the fixation of the spinneret. Here it is irrelevant whether round, rectangular, or annular spinnerets or nozzle plates are used.

Many modifications and other embodiments of the invention set forth herein will come to mind to one skilled in the art to which the invention pertains having the benefit of the teachings presented in the foregoing description and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. An apparatus for melt spinning a plurality of strand-like filaments in a yarn forming operation, comprising a nozzle holder which defines a downwardly open spinneret receptacle, with said receptacle defining an inner wall having a melt outlet extending therethrough, a spinneret comprising a housing which is formed of a single piece of material, said housing includes a central connecting piece having a melt inlet opening extending therethrough, an annular wall extending radially outwardly from the connecting piece, and a collar extending about the outer periphery of the annular wall, said spinneret further comprising a nozzle plate containing a plurality of nozzle openings and mounted to or adjacent said collar of said housing in spaced relation below said annular wall so as to define a diffuser chamber between said annular wall and said nozzle plate, said spinneret being mounted within the receptacle of the nozzle holder with the central connecting piece of the housing abutting the inner wall of the receptacle and so that the melt inlet of the housing communicates with the melt outlet of the nozzle holder, and wherein said annular wall of said housing is sufficiently thin to be elastically deformable when a melt is conducted under pressure into the diffuser chamber of the housing via said melt outlet and said melt inlet, and so as to press the central connecting piece of the spinneret against the inner wall of the receptacle and seal the melt inlet against the melt outlet.

2. The apparatus of claim 1, wherein the spinneret and the nozzle holder are connected to one another by a securing means, and wherein the securing force produced by the securing means and the pressure force produced by the deformation of the annular wall of the housing have the same direction.

3. The apparatus of claim 1, wherein the annular wall of the housing has a form to cause said deformation under pressure to act essentially in one direction wherein the central connecting piece is pressed against the inner wall of the receptacle.

4. The apparatus of claim 1, wherein the annular wall of the housing in the area of the melt inlet of the central connecting piece is formed so that said deformation under pressure acts directly on a sealing face formed between the melt outlet of the nozzle holder and the melt inlet of the housing.

5. The apparatus of claim 4, where the annular wall of the housing is formed as a thin walled spherical cap.

6. The apparatus of claim 1, further comprising a sealing ring disposed between the melt outlet of the nozzle holder and the melt inlet of the housing.

7. The apparatus of claim 1, wherein the receptacle of the nozzle holder includes a cylindrical inside side wall which includes an internal thread, wherein the collar of the housing includes an outside side wall having an external thread, and wherein the internal and external threads are threadedly interconnected to mount the spinneret within the receptacle.

8. The apparatus of claim 1, wherein the housing is of an integral one-piece construction.

9. The apparatus of claim 1, wherein the collar of the housing is supported within a cylindrical sleeve, and the cylindrical sleeve is in turn mounted within the receptacle by a threaded interconnection.

10. The apparatus of claim 9, wherein the nozzle plate is supported on an annular shoulder formed within said cylindrical sleeve.

* * * * *